US009516941B1

(12) United States Patent
Moulton

(10) Patent No.: US 9,516,941 B1
(45) Date of Patent: Dec. 13, 2016

(54) MULTIPURPOSE WEARABLE AND COLLAPSIBLE HOLDER

(71) Applicant: John Moulton, Orlando, FL (US)

(72) Inventor: John Moulton, Orlando, FL (US)

( * ) Notice: Subject to any disclaimer, the term of this patent is extended or adjusted under 35 U.S.C. 154(b) by 0 days.

(21) Appl. No.: 15/040,982

(22) Filed: Feb. 10, 2016

Related U.S. Application Data

(60) Provisional application No. 62/258,606, filed on Nov. 23, 2015.

(51) Int. Cl.

| | |
|---|---|
| ***A47G 25/40*** | (2006.01) |
| ***A45F 5/00*** | (2006.01) |
| ***A47G 23/02*** | (2006.01) |
| ***A45F 5/02*** | (2006.01) |

(52) U.S. Cl.
CPC ..... *A45F 5/00* (2013.01); *A45F 5/021* (2013.01); *A47G 23/0225* (2013.01); *A45F 2005/006* (2013.01)

(58) Field of Classification Search
CPC ..... A45F 5/00; A45F 5/021; A45F 2005/006; A47G 25/40; A47G 25/4015; A47G 25/4046
USPC ..... 224/623, 270, 678, 679; 108/43
See application file for complete search history.

(56) References Cited

U.S. PATENT DOCUMENTS 1,121,422 A * 12/1914 Tydings ..... B41J 29/13 190/11
2,197,735 A * 4/1940 Thomas ..... A47C 1/032 5/12.1
2,415,629 A * 2/1947 Ford ..... B62B 7/10 267/5
2,533,147 A * 12/1950 Sparks ..... B60N 3/007 108/152
4,089,554 A * 5/1978 Myers ..... B60N 3/16 224/498
4,574,990 A * 3/1986 Remis ..... A45C 3/00 190/8
4,852,498 A * 8/1989 Judd ..... A47B 23/043 108/43
4,915,278 A * 4/1990 Smith ..... A45F 3/02 224/236
5,056,696 A * 10/1991 Lahr ..... A45F 5/02 224/148.4
5,060,581 A * 10/1991 Malinski ..... B60N 3/005 108/44

(Continued)

*Primary Examiner* — Brian D Nash
(74) *Attorney, Agent, or Firm* — Timothy Marc Shropshire; Garrett James O'Sullivan; MU Patents

(57) ABSTRACT

A collapsible holder has a front panel, a rear panel, a bottom panel, and two or more arms extending from the rear panel to the front panel. One or more apertures extend through the rear panel for attachment of a neck strap. The front panel, the rear panel, and the bottom panel are formed from a single piece of material, such that the rear panel and the front panel are hingedly connected to, and extend upward from, opposite ends of the bottom panel. The arms may be pivotably connected to the connectors. Additionally, a spring may be incorporated to bias the bottom panel toward the rear panel. The biasing of the bottom panel to the rear panel, combined with the hinged nature of the panels and the pivoting arms, creates lateral compression between the front panel and the rear panel. An accessory compartment may also extend from the rear panel.

16 Claims, 4 Drawing Sheets

(56) References Cited

U.S. PATENT DOCUMENTS 5,295,650 A * 3/1994 Brandt ..... A47C 7/68 108/26
5,421,499 A * 6/1995 Bauer ..... A47B 23/002 108/43
5,639,004 A * 6/1997 Carlton ..... A45C 9/00 190/125
5,642,674 A * 7/1997 Joye, Sr. ..... A47B 23/002 108/25
5,845,585 A * 12/1998 Meeus ..... B60N 3/005 108/165
6,045,017 A * 4/2000 Connell ..... A45F 5/02 224/148.4
6,047,937 A * 4/2000 Huang ..... B60N 3/102 248/311.2
6,427,607 B1 * 8/2002 Palmer ..... A47G 21/08 108/43
6,755,463 B2 * 6/2004 Lardieri ..... A47C 1/03 297/35
7,204,398 B1 * 4/2007 Smith, Sr. ..... A45C 1/08 150/131
7,778,026 B2 * 8/2010 Mitchell ..... A45C 9/00 206/522
8,245,894 B2 * 8/2012 Buehler ..... B62B 5/00 224/282
8,585,135 B2 * 11/2013 Wilson ..... A47C 1/024 297/354.12
2009/0114690 A1 * 5/2009 Landay ..... A45C 7/0054 224/575
2010/0109386 A1 * 5/2010 Hensley ..... A47C 4/32 297/46

* cited by examiner

MULTIPURPOSE WEARABLE AND COLLAPSIBLE HOLDER

CROSS-REFERENCE TO RELATED APPLICATION(S)

The present application claims priority to U.S. Provisional Patent Application No. 62/258,606 filed on Nov. 23, 2015, entitled "Multi-Purpose Wearable Over the Neck Self Retracting Cupholder", the entire disclosure of which is incorporated by reference herein.

BACKGROUND OF THE INVENTION

1. Field of Invention

The present invention relates to the field of holders for beverage containers and other objects, and more specifically to holders that serve multiple purposes such as compartmentalizing and advertising and that can be collapsed when not in use.

2. Description of Related Art

Generally, beverages and food are sold to consumers in containers that are designed to be handheld. These containers come in a multitude of different shapes and sizes, depending on the manufacturer and the type of beverage or food.

There are a number of common situations in which there are issues associated with holding a beverage or food in a hand; most notably when a person is standing or walking, such as in a social setting, party, event, carnival or other situation where many people are gathering and eating and drinking while upright. When a person is standing and using their hands to hold a beverage and/or food, the hand used to hold the beverage or food container is now encumbered and is not free to hold something else or perform other tasks, such as shaking another person's hand in greeting or picking up items such as food or snacks. If a second hand is also encumbered, their hands are not free to perform said previous mentioned tasks unless they put down what is presently encumbering their hand. Often, in social settings, a table or other surface is not readily available or convenient to set a food or drink container onto so that one can perform tasks such as picking up a snack with one hand from a plate being held in the other hand. Alternatively, while walking, it is not practical to put a food or beverage container down while in motion. Furthermore, requiring a user to handle a food or beverage container inhibits personal interaction and cognizance of their surroundings. When a user is required to focus on holding a container and limited to the use of one hand, the user may neglect objects and people around further resulting in injury.

Additionally, at events where many people are gathered and mingling and meeting each other, many people often wear hanging name badges to display their name or other useful information about them. These name badges are often worn around the neck and the neck lanyards and name badges are often adorned with the name of a particular sponsor or company promoting said event. These name badges generally lay flat against a wearer's chest so as to not protrude out appreciably so as to be nuisance.

Based on the foregoing, there is a need in the art for a multipurpose wearable and collapsible holder that folds up flat when not being used but unfolds to hold a drink container or other object when placed into the top of the holder. Additionally, the holder could serve as a prominent name badge as well as a holder for accessories such as a cell phone. The holder can be worn around the user's neck by way of an attachable lanyard for the purpose of freeing the user's hands to improve social interaction or allow the user to perform tasks.

SUMMARY OF THE INVENTION

A multipurpose wearable and collapsible holder has a front panel, a rear panel, a bottom panel, two or more arms extending from the rear panel to the front panel, and a means for securing the holder to an object. The front panel, the rear panel, and the bottom panel are formed from a single piece of material, such that the rear panel and the front panel are hingedly connected to, and extend upward from, opposite ends of the bottom panel.

In an embodiment, the holder also has one or more connectors extending outward from one or more edges of the rear panel and the front panel. The arms are pivotably connected to the connectors.

In an embodiment, a spring biases the bottom panel toward the rear panel, creating lateral compression between the front panel and the rear panel, such that when an object is removed from the collapsible holder, the spring provides a self-retracting force to fully fold the collapsible holder in an upward direction to close the collapsible holder. Example embodiments of the spring are a mechanical spring or an elastic band.

In an embodiment, the upper edge of the rear panel and the front panel are cupped.

In an embodiment, one or more depressions extend into the bottom panel for receiving a bottom surface of a container.

In an embodiment, the holder also has an accessory compartment extending from the rear panel. The compartment has a plurality of sides, an open end, and a closed end. In an embodiment, the compartment is detachable from the rear panel. In an alternative embodiment, the compartment is integrally attached to the rear panel, such that the rear panel is one of the sides of the compartment.

In an embodiment, an interior surface of the rear panel, an exterior surface of the front panel, and an exterior surface of the bottom panel are smooth. To allow for the placement of advertising.

In an embodiment, the holder further comprises a clip. In an embodiment, the clip is formed from a generally "U" shaped cutout on the rear panel and/or the accessory compartment. In an alternative embodiment, the clip is attached to, and extends outward from, a rear portion of the rear panel or the accessory compartment. The clip allows the holder to be releasably attached to an object, such as a belt or a waistline.

In an embodiment, the rear panel has one or more apertures extending there through, wherein the means for securing the holder to an object is a neck strap in communication with the one or more apertures. In an embodiment, the length of the neck strap is adjustable. In yet a further embodiment, the neck strap has an extension that releasably engages the one or more apertures to secure the strap to the rear panel.

In an embodiment, the single piece of material that forms the front panel, the rear panel, and the bottom panel is injection molded plastic. Fold lines are created in the plastic during the manufacturing process to create embedded hinges between the rear panel and the bottom panel, and the bottom panel and the front panel.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
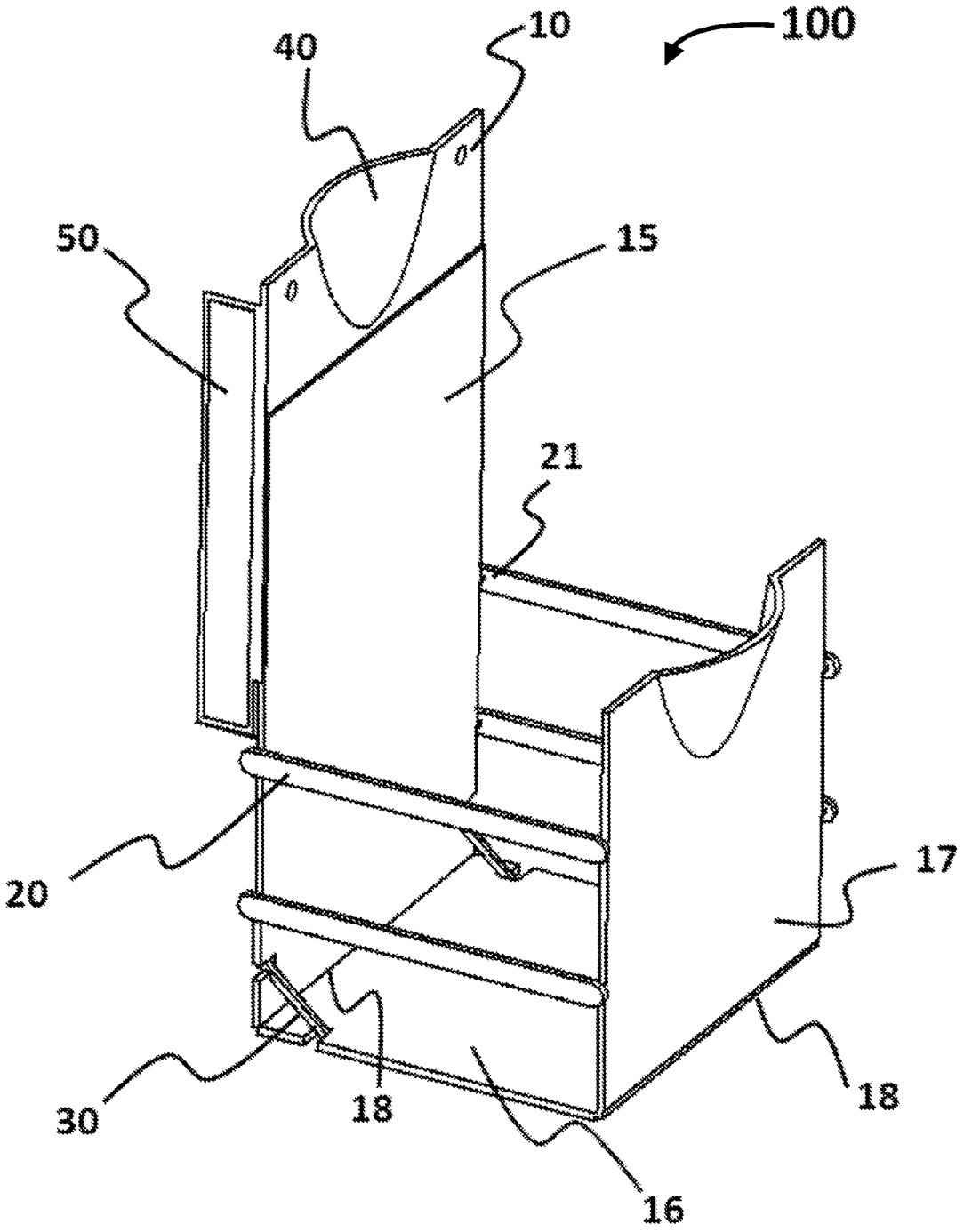
FIG. 1 is a front perspective view of the multipurpose wearable and collapsible holder, in its fully open position, according to an embodiment of the present invention.

Preferred embodiments of the present invention and their advantages may be understood by referring to FIGS. 1-4, wherein like reference numerals refer to like elements.

Figure 2:
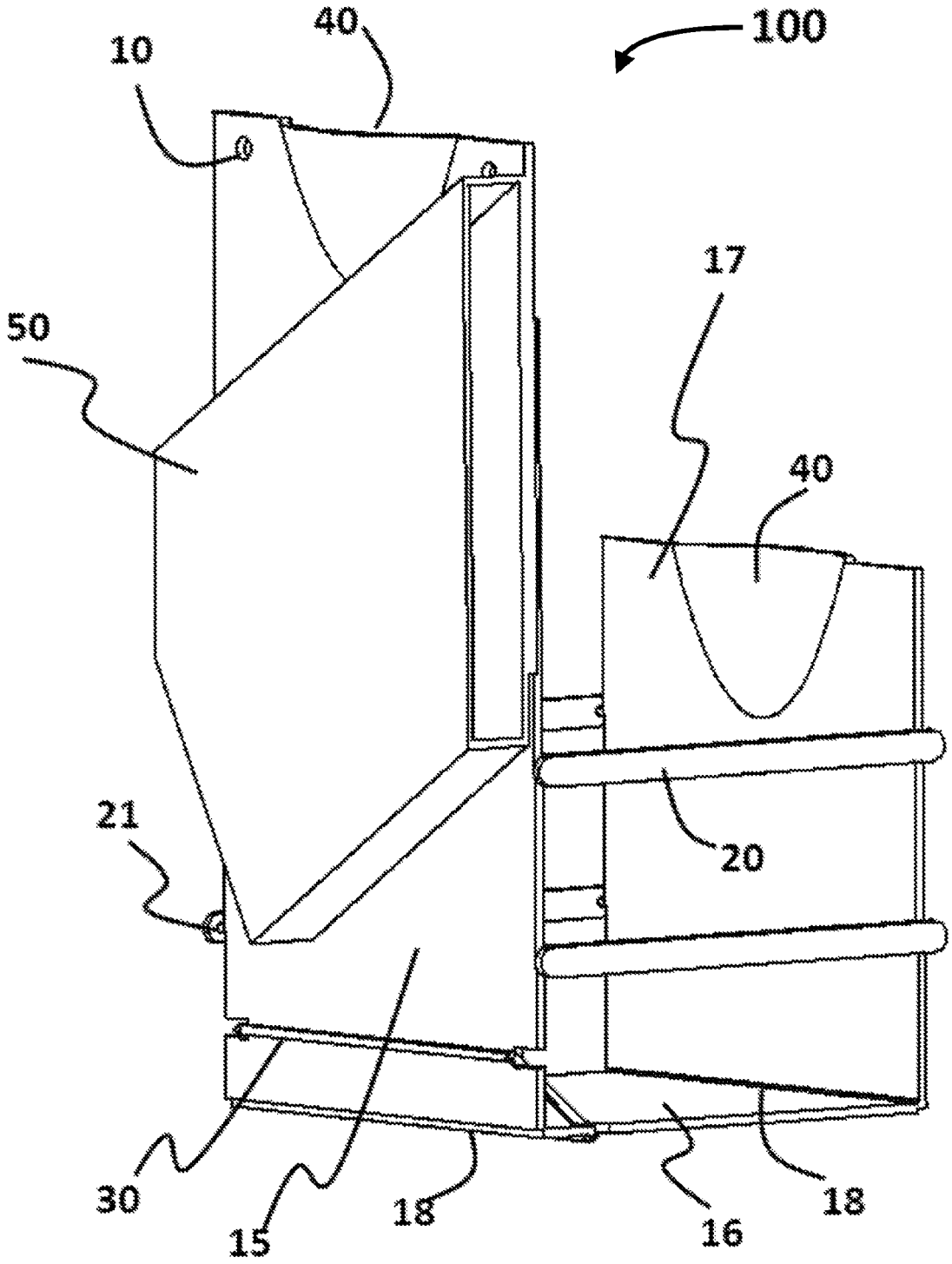
FIG. 2 is a rear perspective rear view of the multipurpose wearable and collapsible holder in its fully open position, according to an embodiment of the present invention.
Figure 3:
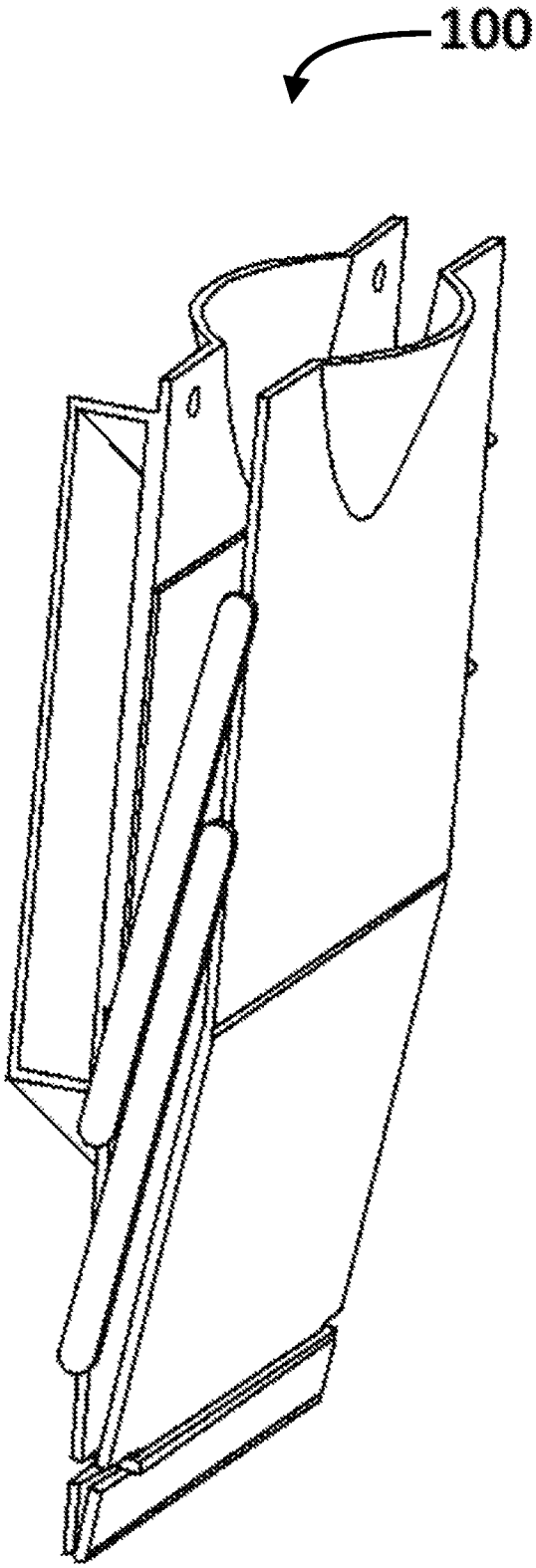
FIG. 3 is a perspective view of the multipurpose wearable and collapsible holder in its fully closed position, according to an embodiment of the present invention.

With reference to FIG. 1, a front perspective view of the multipurpose wearable and collapsible holder 100 is shown in its fully open position. The collapsible holder 100 has a rear panel 15, a bottom panel 16, and a front panel 17. The bottom panel 16 is connected integrally to the base of each the rear panel 15 and the front panel 17. The panels 15, 16, 17 are formed from a single piece of material, such as card stock or plastic, that is folded or bent to form the respective panels 15, 16, 17 as shown in FIGS. 1-3. By folding the material to create the panels 15, 16, 17, hinged breaks are created between the panels 15, 16, 17, such that the rear panel 15 is hingedly connected to the bottom panel 16, and the bottom panel 16 is hingedly connected to the front panel 17. In an embodiment, fold lines are created during the manufacturing process to create embedded or living hinges 18 between the rear panel 15 and the bottom panel 16, and the bottom panel 16 and the front panel 17. This can be accomplished, for example, by a reduction in thickness of the material, e.g., a single piece of extruded plastic, along a line of bend to make the respective hinges. A neck strap (not shown), e.g., a necklace, a lanyard, or a tether, or an extension thereof, e.g., a lanyard clip, clasp, or hook, removably engages with one or more apertures 10 extending through the rear panel 15 to secure the neck strap to the rear panel 15. Alternatively, the neck strap attaches to a hook, clip, clasp, or other similar attachment apparatus (not shown) connected to the rear panel 15. In an embodiment, the length of the strap is adjustable. Once the strap has been attached to the collapsible holder 100 the user positions the strap around his/her neck to support the collapsible holder 100 in position on the user. One or more arms 20 extend from the rear panel 15 to the front panel 17. In an embodiment, one or more connectors 21, such as a pin, a tab, or a button, are attached to, and extend outward from, one or more edges of each of the rear panel 15 and the front panel 17. The arms 20 attach to the connectors 21, allowing the arms 20 to be pivotably connected to the rear panel 15 and the front panel 17. The pivoting nature of the arms 20 in combination with the hinged nature of the panels 15, 16, 17, allows the collapsible holder to transition from a closed position (see FIG. 3) to an open position (see FIGS. 1-2), and vice versa. The arms 20 provide both support for the left and right side of the collapsible holder 100 and containment for an object, e.g., a beverage container, inserted into the collapsible holder 100.

Figure 4:
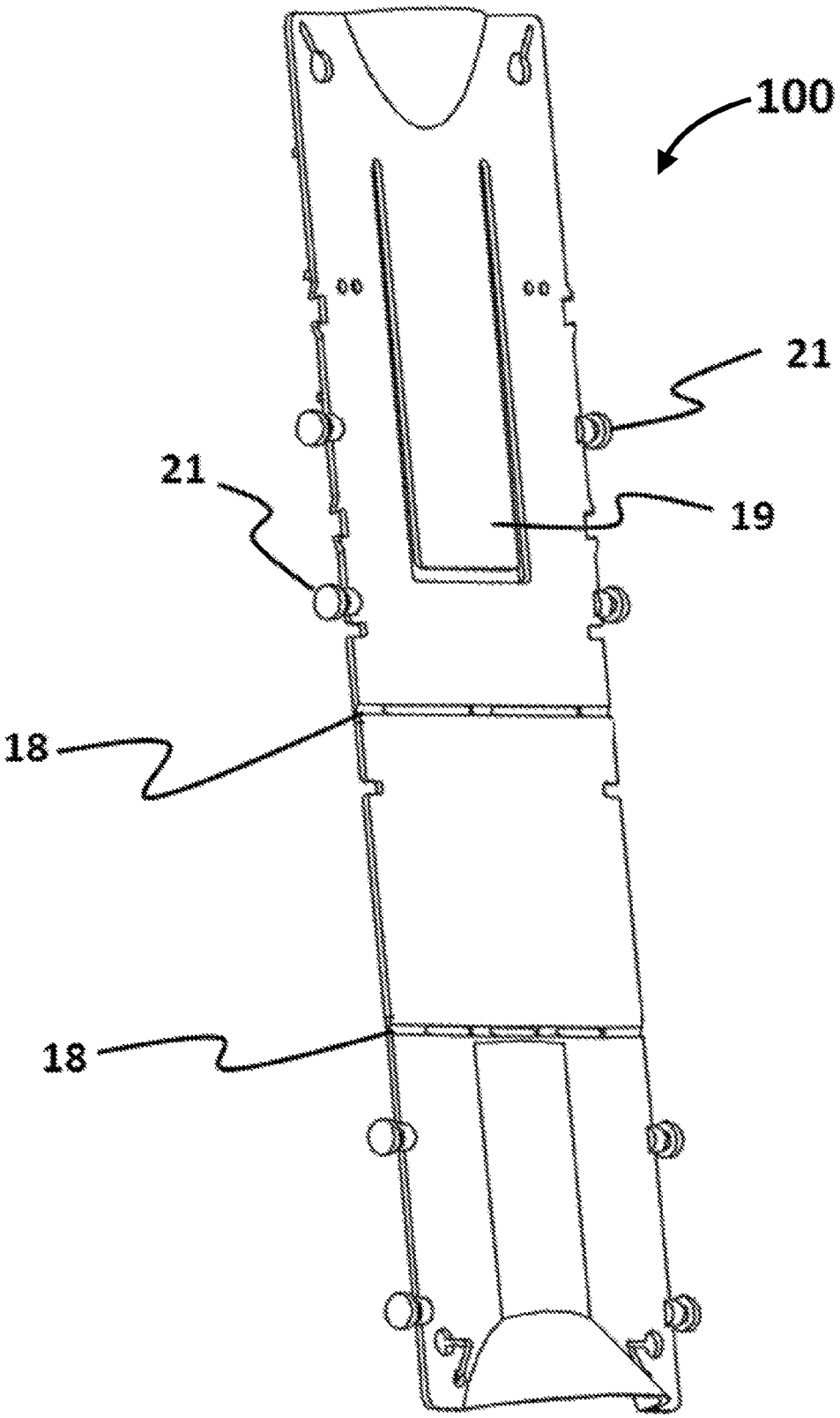
FIG. 4 is a perspective view of a single injection molded piece of plastic comprising the entirety of the rear, bottom and front panels as well as integral living hinges.

With reference to FIG. 4, in an embodiment, the rear panel 15 has a clip 19 that allows the collapsible holder 100 to be clipped to an object, such as the user's belt, waistline, pocket, backpack, etc. In an embodiment, the clip 19 is formed from a generally "U" shaped cutout on the rear panel 15 that flexes out to allow the clip 19 to releasably engage with an object. Alternatively, the clip 19 is attached to, and extends outward from, a rear portion of the rear panel 15 or the accessory compartment 50.

In an embodiment, the collapsible holder is constructed from a single piece of extruded plastic manufacturing concept where the hinges (one between the bottom and the rear panel and the other between the bottom and the front are embedded, living hinges created by a reduction in thickness of the plastic along a line of bend to make the hinge. This "uni piece" design is a critical claim to make in this invention.

In an embodiment, cupped reliefs 40 are included at the upper edges of the rear panel 15 and the front panel 17. The reliefs 40 are designed to assist with opening the collapsible holder 100 during the initial placement of a beverage container into the collapsible holder 100. Additionally, the reliefs 40 assist in centering and stabilizing the beverage container once placed into the collapsible holder 100.

In an embodiment, the bottom panel 16 is biased toward the rear panel 15 by a spring 30, e.g., a mechanical spring or an elastic band. A first end of the spring 30 is connected to the bottom panel 16 and the second end is connected to the rear panel 15. When the collapsible holder 100 is empty, it is maintained in the closed position, as illustrated in FIG. 3. As a container or other object is pushed downward into the collapsible holder 100, the collapsible holder 100 opens (see FIGS. 1-2), causing the spring 30 to become tensioned. The biasing force of the spring 30, in combination with the panels 15, 16, 17 being pivotably and hingedly interconnected, creates lateral compression between the front panel 17 and the rear panel 15, allowing the container to be securely retained between the front panel 17 and the rear panel 15. When the object is removed from the collapsible holder 100, the biasing force of the spring 30 provides a self-retracting force to fully fold the collapsible holder 100 in an upward direction to close the collapsible holder 100. The collapsible holder 100 can easily be stowed in the user's pocket or bag/purse when in the closed position, as seen in FIG. 3.

In an embodiment, an accessory compartment 50 extends from the rear panel 15. The accessory compartment 50 is a cavity defined by a plurality of sides, an open end, and a closed end. In an embodiment, the accessory compartment 50 is detachable from the rear panel 15. In an alternative embodiment, the accessory compartment 50 is integrally attached to the rear panel 15, such that one of the sides is the rear panel 15. The accessory compartment 50 is configured to receive various items, e.g., a mobile device, identification cards, credit cards, currency, or car keys, placed therein.

In an embodiment, the front panel 17 and the rear panel 15 are contoured to receive a beverage container. For example, in one embodiment, the front panel 17 and the rear panel 15 are outwardly angled, such that the collapsible holder 100 is better adapted to receive a frustoconically-shaped container. In another embodiment, the front panel 17 and the rear panel are oriented parallel to one another, such that the collapsible holder 100 is better suited for receiving generally rectangular or cylindrical containers.

In an embodiment, the bottom panel 16 has one or more depressions or protrusions (not shown) for receiving a bottom surface of a beverage container when the beverage container is inserted into the collapsible holder 100.

In an embodiment, the inside surface of the rear panel 15 and the outside surfaces of the front panel 17 and the bottom panel 16 are smooth and can accept name stickers, promotional ads (stickers or printed).

In an embodiment, a user facilitates a transition from the closed position to the open position by securing/holding the rear panel 15 in place and pulling the front panel 17 in a downward and outward direction with respect to the rear panel 15. Alternatively, a container or other object can be lowered between reliefs 40, such that as the object is lowered, the front panel 17 and the rear panel 15 are forced apart from one another. As the front panel 17 is moved away from the rear panel 15, the ends of the arms 20 pivot on the edges of the front panel 17 and rear panel 15 to guide the alignment of the front panel 17 with the rear panel 15. The front panel 17 is moved away from the rear panel 15 until the arms 20 are generally perpendicular to the front and rear panels 17, 15. At this point, the collapsible holder 100 is in the open position, in which the arms 20 prevent the front and rear panels 17, 15 from separating any further as the bottom panel 16 is now parallel to the pivoting arms 20. In the open position, the arms 20 are positioned at a generally right angle with the front panel 17 and the rear panel 15, respectively.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A multipurpose wearable and collapsible holder comprising:

a. a front panel;

b. a rear panel;

c. a bottom panel;

d. two or more arms, each arm in communication with the rear panel and the front panel;

e. a means for securing the holder to an object and f. a spring in communication with the bottom panel and the rear panel, wherein the spring biases the bottom panel toward the rear panel to create lateral compression between the front panel and the rear panel, wherein when an object is removed from the collapsible holder, the spring provides a self-retracting force to fully fold the collapsible holder in an upward direction to close the collapsible holder, wherein the front panel, the rear panel, and the bottom panel are formed from a single continuous piece of material, and wherein the rear panel and the front panel are foldably engaged to opposite ends of the bottom panel.

2. The multipurpose wearable and collapsible holder of claim 1, further comprising one or more connectors extending outward from one or more edges of the rear panel and the front panel, wherein the arms are pivotably connected to the connectors.

3. The multipurpose wearable and collapsible holder of claim 1, wherein the spring is an elastic band.

4. The multipurpose wearable and collapsible holder of claim 1, wherein the bottom panel comprises one or more depressions for receiving a bottom surface of a container.

5. The multipurpose wearable and collapsible holder of claim 1, further comprising an accessory compartment in communication with the rear panel comprising:

a. a plurality of sides;

b. an open end; and c. a closed end.

6. The multipurpose wearable and collapsible holder of claim 5, wherein the accessory compartment is detachable from the rear panel.

7. The multipurpose wearable and collapsible holder of claim 5, wherein the accessory compartment is integrally attached to the rear panel, wherein the rear panel is one of the sides of the accessory compartment.

8. The multipurpose wearable and collapsible holder of claim 5, wherein the accessory compartment comprises a clip for securing the holder to an object.

9. The multipurpose wearable and collapsible holder of claim 1, wherein an interior surface of the rear panel, an exterior surface of the front panel, and an exterior surface of the bottom panel are smooth.

10. The multipurpose wearable and collapsible holder of claim 1, wherein the rear panel comprises one or more apertures extending there through, wherein the means for securing the holder to an object is a neck strap in communication with the one or more apertures.

11. The multipurpose wearable and collapsible holder of claim 10, wherein a length of the strap is adjustable.

12. The multipurpose wearable and collapsible holder of claim 10, wherein the neck strap comprises an extension that releasably engages the one or more apertures to secure the strap to the rear panel.

13. The multipurpose wearable and collapsible holder of claim 1, wherein the means for securing the holder to an object is a clip in communication with the rear panel.

14. The multipurpose wearable and collapsible holder of claim 13, wherein the clip is formed from a generally "U" shaped cutout on the rear panel.

15. The multipurpose wearable and collapsible holder of claim 13, wherein the clip is attached to, and extends outward from, a rear portion of the rear panel.

16. The multipurpose wearable and collapsible holder of claim 1, wherein the single piece of material that forms the front panel, the rear panel, and the bottom panel is injection molded plastic, wherein fold lines are created during the manufacturing process to create embedded hinges between the rear panel and the bottom panel, and the bottom panel and the front panel.

* * * * *